US008869664B2

(12) United States Patent
Eyles et al.

(10) Patent No.: US 8,869,664 B2
(45) Date of Patent: Oct. 28, 2014

(54) FOOD SLICING AND WEIGHING SYSTEM

(75) Inventors: Jonathan Thomas Eyles, Wakefield (NZ); Sean Colin Marr, Nelson (NZ)

(73) Assignee: Titan Slicer Limited (NZ)

( * ) Notice: Subject to any disclaimer, the term of this patent is extended or adjusted under 35 U.S.C. 154(b) by 532 days.

(21) Appl. No.: 13/185,129

(22) Filed: Jul. 18, 2011

(65) Prior Publication Data

US 2013/0019722 A1 Jan. 24, 2013

(51) Int. Cl.
*B26D 7/30* (2006.01)
*B26D 5/40* (2006.01)
*B26D 7/32* (2006.01)

(52) U.S. Cl.
CPC ... *B26D 7/30* (2013.01); *B26D 7/32* (2013.01); *B26D 2210/02* (2013.01)
USPC ..... 83/75.5; 83/77

(58) Field of Classification Search
USPC ..... 83/75.5, 77; 700/171
See application file for complete search history.

(56) References Cited

U.S. PATENT DOCUMENTS 3,827,319 A * 8/1974 Flesch ..... 83/73
4,794,996 A * 1/1989 Wallace et al. ..... 83/77
5,042,340 A * 8/1991 Kasper ..... 83/77
5,136,906 A 8/1992 Antonissen et al.
5,267,168 A 11/1993 Antonissen et al.
8,116,554 B2 2/2012 Burton
2010/0212465 A1 * 8/2010 Tillman et al. ..... 83/23

FOREIGN PATENT DOCUMENTS

EP 0449512 A1 10/1991
WO 2011/056602 A1 5/2011

* cited by examiner

*Primary Examiner* — Stephen Choi
(74) *Attorney, Agent, or Firm* — Charles Knobloch; Arnold, Knobloch & Saunders, L.L.P.

(57) ABSTRACT

A food slicing and weighing system produces stacks of slices of food product. Each stack has a total number of slices or a weight greater than a predetermined minimum stack weight. The food slicing and weighing line comprises a slicing unit and a weighing unit. The slicing unit has a blade for cutting slices off a log of food and a control arrangement comprising a controller for setting the thickness of the slices. The weighing unit has a surface supported by a load sensor. The surface is positioned at the location the slices are cut off the log, each slice dropping onto the surface as each slice is cut from the log. The load sensor senses the weight of the slices as each slice is dropped onto the surface and provides a signal to the controller. The controller determines from the signal a measured combined weight of a number of slices less than the total number of slices and then a target thickness for a next slice to be added to the stack of slices based on the measured combined weight.

10 Claims, 6 Drawing Sheets

FOOD SLICING AND WEIGHING SYSTEM

FIELD OF THE INVENTION

The present invention relates to equipment for slicing and weighing food, for example cheese and meat products such as bacon.

BACKGROUND TO THE INVENTION

Food retailers such as supermarkets provide packets of pre-sliced food such as sliced bacon and sliced cheese.

Sliced food producers utilize slicing and weighing production lines to cut slices from a log of food. The log of food is fed into an entry side of a slicing unit and the slicing unit cuts slices from the log of food and places the slices onto a conveyor at an exit side of the slicing unit.

Typically a stack of slices is prepared before the conveyor transports that stack to a weigh unit or weigh station. The conveyor remains stationary during the slicing operation so that a stack or group of slices is stacked from the slicing unit onto the conveyor.

Once a predetermined number of slices have been cut, the conveyor transports the stack of slices to a weigh station. The stack is weighed at the weigh station and is either directed to a packing area if the weight of that stack is above a minimum requirement, or directed to a make-up station if the stack is underweight.

At the make-up station the underweight stack of slices is made up to the required minimum weight by an operator who adds an additional slice to the pack before it is directed to the packing area. This make-up operation is undesirable as it involves labour and can result in a pack weight that significantly exceeds the minimum weight requirement. Where a pack is sold based on the minimum weight amount, any excess weight over that minimum pack weight is given away as free product resulting in lost revenue.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved food slicing and weighing system or an improved weigh unit for a food slicing and weighing system or to at least provide the food processing industry with a useful choice.

SUMMARY OF THE INVENTION

In one aspect, the present invention consists in a food slicing and weighing system for producing groups of slices of food product, each group of slices having a total number of slices or a weight greater than or equal to a minimum predetermined group weight, the food slicing and weighing system comprising:

a slicing unit having a blade for cutting slices off a log of food, each slice having a slice thickness, a weighing unit having a load sensor, the weighing unit positioned at the location the slices are cut off the log, the load sensor adapted to sense the weight of slices as each slice is received on the weigh unit, and the load sensor providing a signal, the signal relating to the weight of slices on the weigh unit, and a controller receiving the signal or data based on the signal, the controller programmed to:

i) after each slice is received on the weigh unit for a group of slices determine based on the signal or the data a calculated thickness for a next slice to be cut from the log and received on the weigh unit, ii) provide an output to the slicing unit to set the slice thickness to the calculated thickness, iii) repeat steps i) and until the group of slices has been completed, wherein the signal or the data provides an indication of the combined weight of slices received on the weigh unit for a group of slices or the controller calculates from the signal or the data an indication of the combined weight of slices received on the weigh unit for a group of slices, and in step i) the controller determines the calculated thickness based on the indication of the combined weight.

Preferably the weighing unit comprises a conveyor supported by the load sensor, the conveyor positioned at the location the slices are cut off the log for receiving the slices to be weighed by the load sensor.

Preferably once the cutting of a group of slices has been completed and the group of slices has been received on the weigh unit, the conveyor is controlled to transfer the group of slices from the weigh unit so that the conveyor is vacant for receiving a first slice of a next group of slices.

In another aspect, the present invention consists in a food slicing and weighing system for producing groups of slices of food product, each group of slices having a total number of slices or a weight greater than or equal to a minimum predetermined group weight, the food slicing and weighing system comprising:

a slicing unit having a blade for cutting slices off a log of food, each slice having a slice thickness, a weighing unit having a load sensor, the weighing unit positioned at the location the slices are cut off the log, the load sensor adapted to sense the weight of slices as each slice is received on the weigh unit, and the load sensor providing a signal, the signal relating to the weight of slices on the weigh unit, and a controller receiving the signal or data based on the signal and based on the signal or the data the controller determining a calculated thickness for slices to be cut from the log and received on the weigh unit to complete a group of slices, the controller providing output to the slicing unit to set the slice thickness to the calculated thickness.

Preferably based on the signal or the data the controller determines the calculated thickness and provides the output to the slicing unit to set the slice thickness to the calculated thickness at least twice to complete a group of slices.

Preferably in at least 95% of the groups of slices produced by the food slicing and weighing system the weight of each group of slices is less than 3% heavier than the minimum predetermined group weight.

Preferably after each slice is received on the weigh unit, based on the signal or the data the controller determines the calculated thickness and provides the output to the slicing unit to set the slice thickness to the calculated thickness for the next slice to be cut from the log and received on the weigh unit until a group of slices is completed.

Preferably the signal or the data provides an indication of the combined weight of slices received on the weigh unit for a group of slices or the controller calculates from the signal or the data an indication of the combined weight of slices received on the weigh unit for a group of slices, and the controller determines the calculated thickness based on the indication of the combined weight.

Preferably the controller's determination of the calculated thickness is also based on the calculated thickness determined for a previous slice cut from the log and the weight of the previous slice cut from the log.

Preferably the slicing unit comprises a camera for taking an image of the log and providing a camera signal, the controller receiving the camera signal or data based on the camera signal and based on the cameral signal the controller determining an indication of the cross sectional area of the log, or the data providing an indication of the cross sectional area of the log, and the controller determining the calculated thickness based on the indication of the cross sectional area, a density and the indication of the combined weight.

Preferably the controller determines the density based on the camera signal.

Preferably the food product is meat having a fat content and a non-fat content, and the controller estimates a fat and non-fat content for a slice to be cut from the log based on the camera signal and determines the density based on the estimated fat and non-fat content and a known fat density and a known non-fat density, or wherein the food product has cavities and based on the camera signal the controller estimates the percentage of cavities in a slice to be cut from the log and the controller determines the density based on the estimated percentage of cavities and a known density for the food product without cavities.

Preferably the weighing unit comprises a conveyor supported by the load sensor, the conveyor positioned at the location the slices are cut off the log for receiving the slices to be weighed by the load sensor.

Preferably each slice drops from the log onto the conveyor after being cut from the log.

Preferably once the cutting of a group of slices has been completed and the group of slices has been received on the weigh unit, the conveyor is controlled to transfer the group of slices from the weigh unit so that the conveyor is vacant for receiving a first slice of a next group of slices.

Preferably the conveyor comprises a belt supported by two spaced apart rollers, and the weighing unit comprises a motor removably coupled to at least one of the rollers for driving the belt and a support frame for supporting the conveyor and the motor, the support frame being supported by the load sensor, and the conveyor resting on the support frame and being removable from the support frame without tools.

Preferably the slicing unit comprises a user interface allowing an operator to enter for use by the controller one or more of a user defined target slice weight, a user defined target slice thickness, the total number of slices and the predetermined minimum stack weight, and the controller determines the calculated thickness for at least a first slice of a group of slices based on one or more of the user defined target slice weight, the user defined target slice thickness, the total number of slices, the predetermined minimum stack weight, a calculated thickness and a weight of a slice from a previous group of slices.

In another aspect, the present invention consists in a method for producing groups of slices of food product by cutting slices off a log of food, each group of slices having a total number of slices or a weight greater than or equal to a minimum predetermined group weight, the method comprising:

i) cutting a first slice for a group of slices from the log, ii) weighing the first slice to determine a measured weight of the first slice indicative of the weight of the first slice, iii) determining a target thickness based on the measured weight of the first slice, iv) cutting a second slice for the group of slices according the target thickness, v) weighing the slices to determine a measured combined weight of the slices for the group of slices indicative of the combined weight of the slices, vi) re-determining the target thickness depending on the measured combined weight, vii) cutting a next slice for the group of slices according the re-determined target thickness, viii) repeating steps v) to vii) until a predetermined number of slices have been cut and added to the group of slices or the measured combined weight of the slices cut from the log and added to the group of slices is greater than a predetermined minimum group weight.

Preferably step i) the method comprises:

i) cutting the first slice for the group of slices according to a user defined thickness or a thickness setting from a previous group of slices.

Preferably in step i) the method comprises:

i) a) using a camera to capture an image of the log, i) b) determining from the image a cross sectional area of the log, i) c) determining a target slice weight for the first slice based on one or more of a user defined target slice weight, the predetermined number of slices and the predetermined minimum group weight, i) d) determining a target thickness for the first slice based on the target slice weight for the first slice, the cross sectional area for the log, and a density for the log, i) e) cutting the first slice for the group of slices according to the target thickness for the first slice.

Preferably in step vi) the method comprises:

vi) a) using a camera to capture an image of the log, vi) b) determining from the image a cross sectional area of the log, vi) c) determining a target slice weight based on the measured combined weight, vi) d) re-determine the target thickness based on the target slice weight, the cross sectional area of the log and a density for the log.

Preferably the method comprises:

determining a fat content and a non-fat content for a slice to be cut from the log based on the image and determining the density based on the fat and non-fat content and a known fat density and a known non-fat density, or determining a percentage of cavities in a slice to be cut from the log and determining the density based on the estimated percentage of cavities and a known density for the food product without cavities.

Preferably in step vi) the method comprises:

vi) a) determining a target slice weight based on the measured combined weight, vi) b) re-determining the target thickness based on the target slice weight, the target thickness for a previous slice cut from the log and the weight of the previous slice cut from the log.

In another aspect, the present invention consists in a frame for a food slicing machine, the frame being constructed from members with a circular cross section, the frame being without covers or panels, the frame members being absent of flat surfaces on which debris could collect.

Preferably the frame members are tubular.

Preferably the frame is a welded frame having welded joins between members.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

Figure 1:
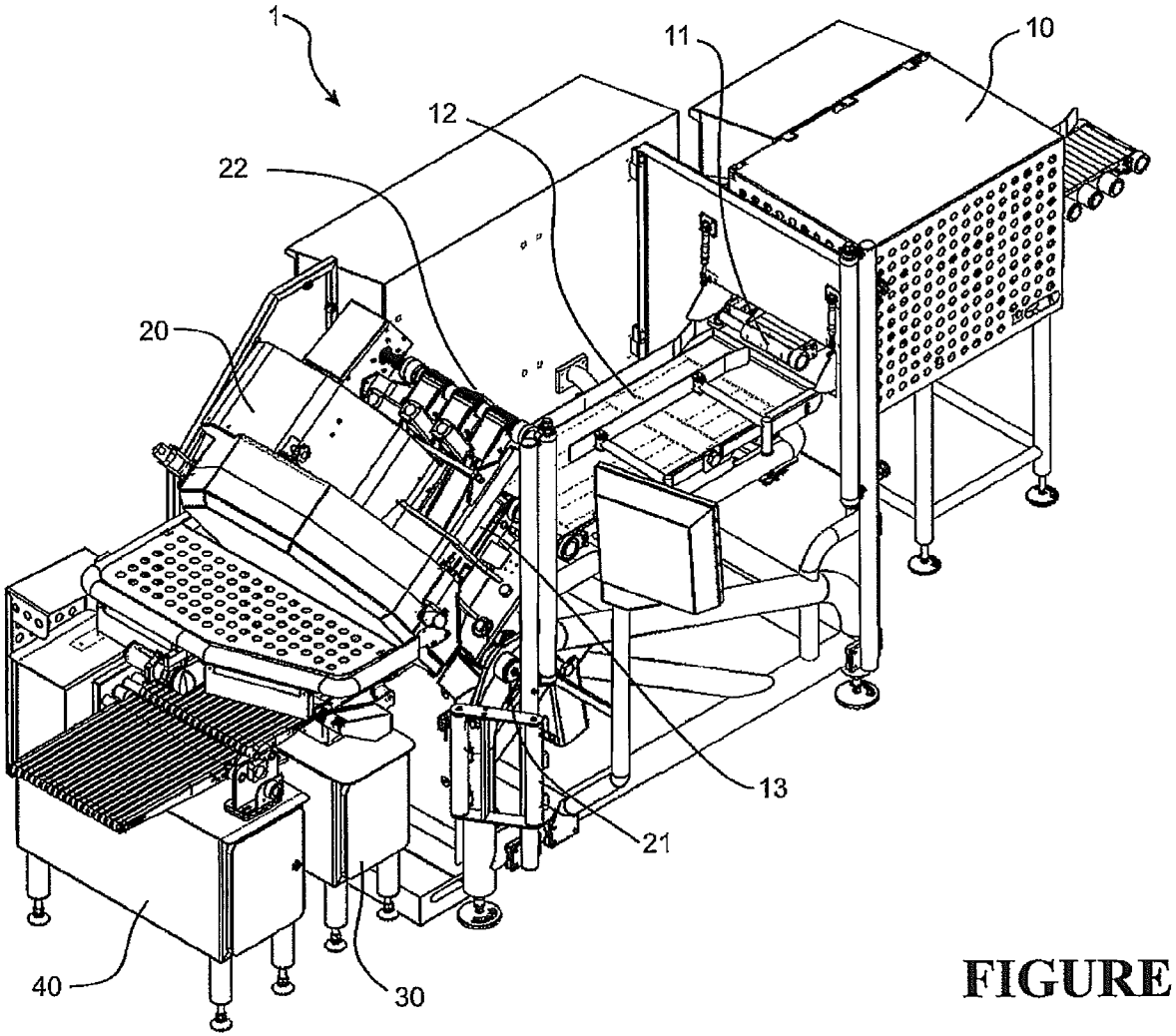
FIG. 1 is a perspective view of a food slicing and weighing system comprising a side trimmer unit, a slicing unit, a weighing unit, and an exit conveyor selector unit.
Figure 2:
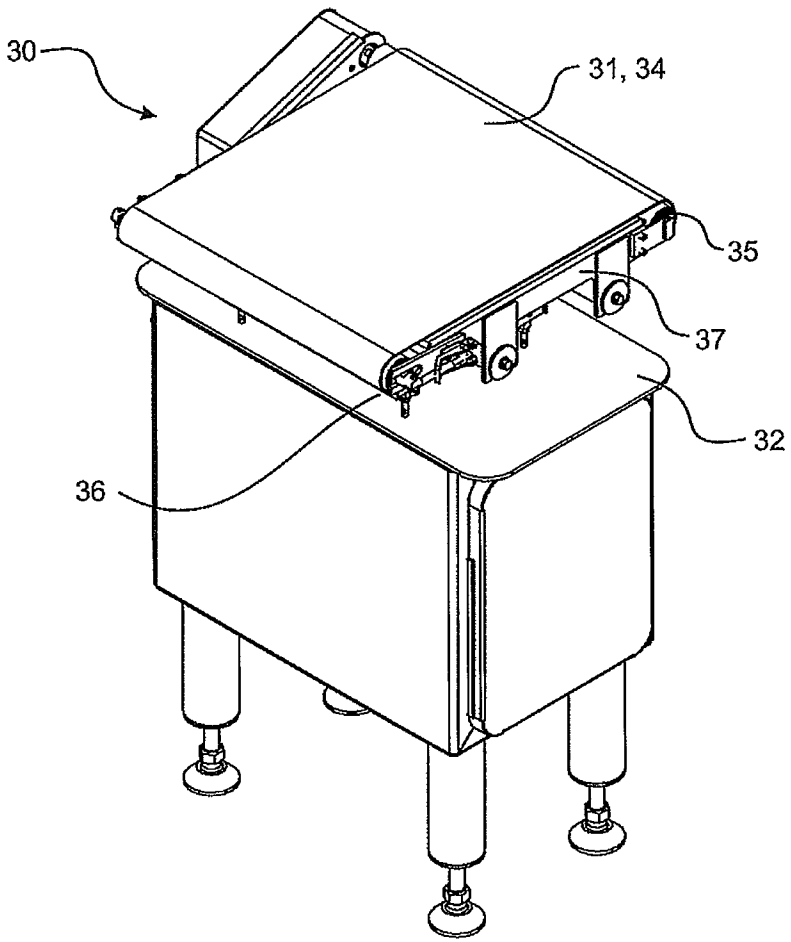
FIG. 2 shows a perspective view of a weighing unit.
Figure 3B:
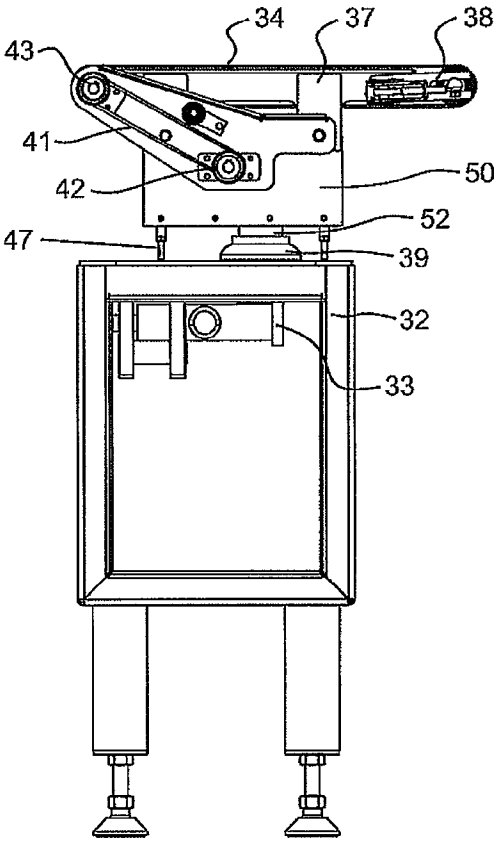
FIG. 3A and FIG. 3B is a side view and an end view of the weighing unit of FIG. 2 with safety guards removed so that features of the weighing machine are shown.
Figure 3A:
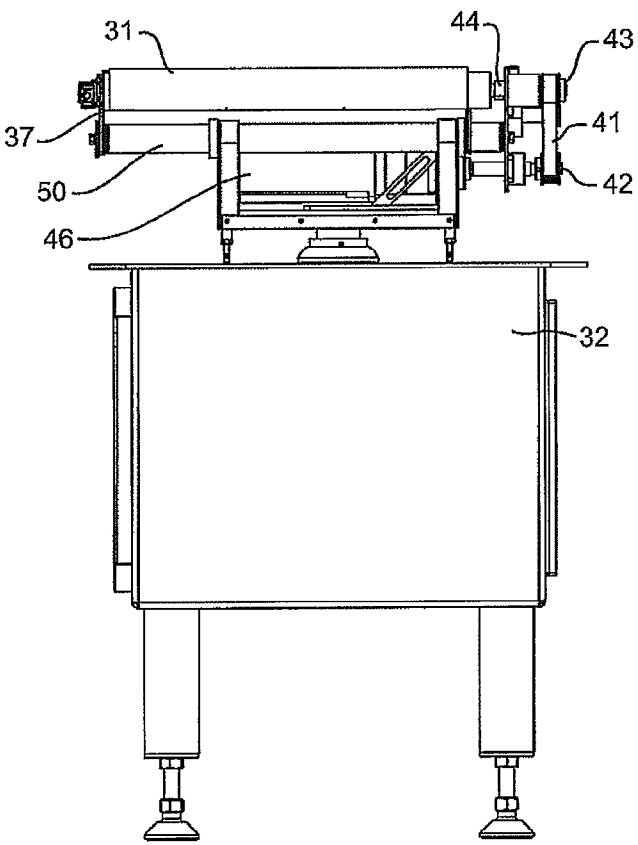
Figure 4B:
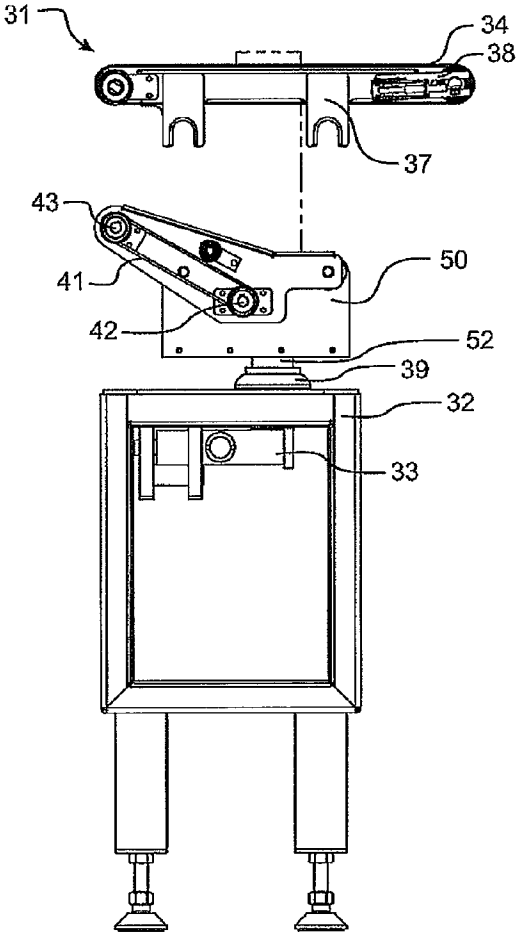
FIG. 4A and FIG. 4B is a side and end view of FIG. 4 the weighing unit of FIG. 2 with safety guards removed so that features of the weighing machine are shown and with a conveyor lifted off the weighing unit assembly.
Figure 4A:
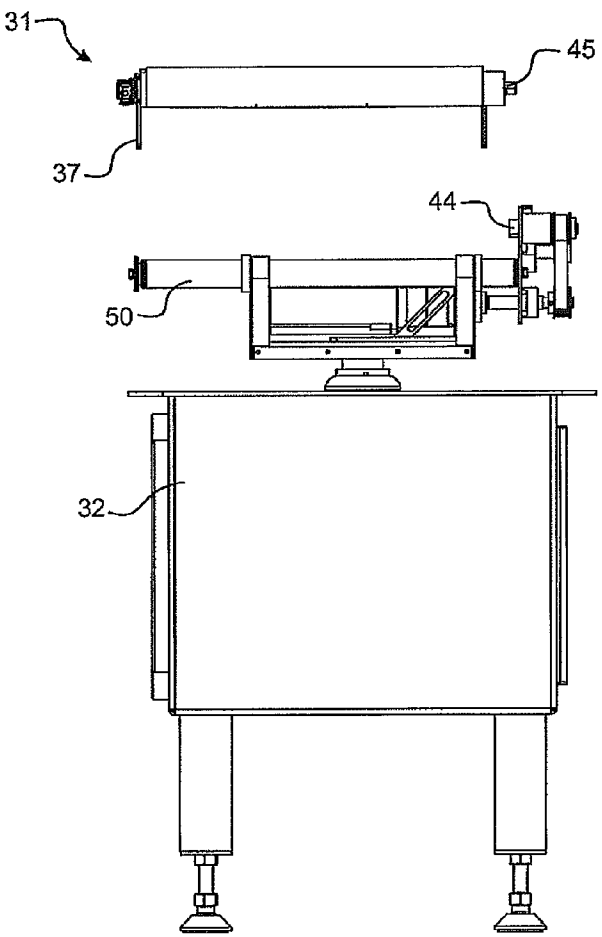
Figure 5:
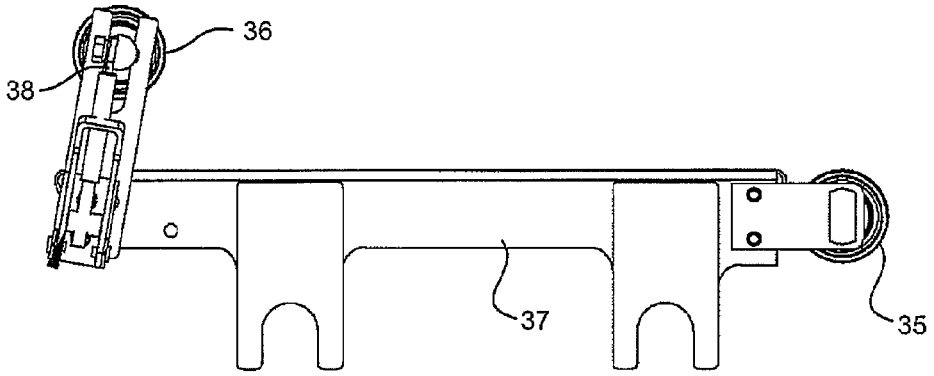
FIG. 5 is a side view of a conveyor frame that forms part of the weighing unit of FIG. 2.
Figure 6:
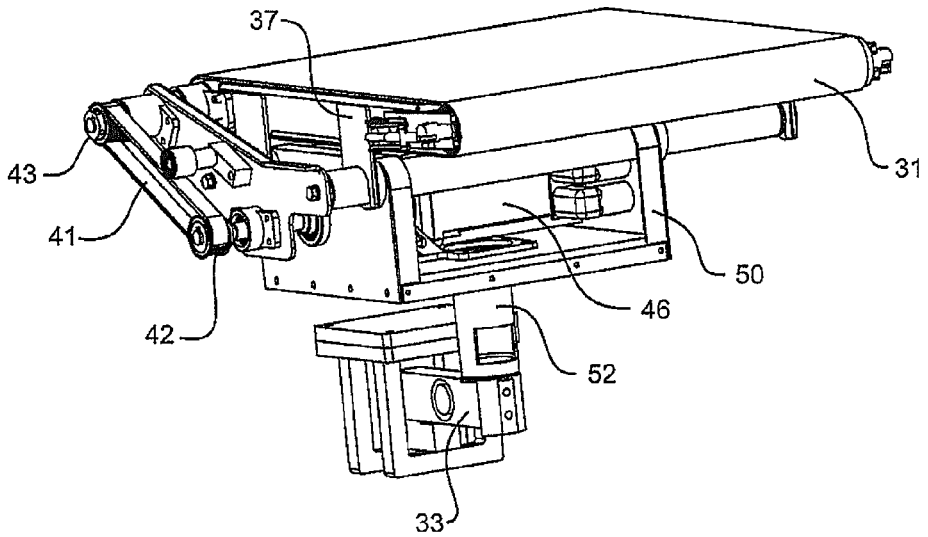
FIG. 6 is a perspective view of a subassembly of the weigh unit comprising the conveyor, a support frame supporting the conveyor, and load cell supporting the support frame via a post.

The present invention relates to equipment for slicing and weighing food, for example cheese, and meat products such as bacon. FIG. 1 shows a food slicing and weighing production line or system. This particular food slicing line comprises four units, a side trimmer unit at an entry end of the line, a slicing unit, a weighing unit and a conveyor selector unit at the exit end of the line. In this example processing line, the side trimmer unit, slicing unit, weighing unit and conveyor selector unit are stand alone or individual units. These individual units are arranged side-by-side on a floor surface to form the production line. Alternatively a food slicing and weighing production line may comprise a common frame for supporting various trimming, slicing, weighing and conveying equipment. A food slicing line according to one embodiment of the present invention comprises a slicing unit and a weighing unit.

The slicing and weighing production line slices a food product such as a log of meat into separate slices for packaging into a packet containing one or more and typically a plurality of slices in a single packet for sale by a food retailer, for example a supermarket.

With reference to FIG. 1, a log of a food product such as a side of bacon is loaded onto a conveyor 11. The conveyor 11 transports the log through the side trimmer where a blade (not shown) trims the log to a required width. The side trimmed log exits an exit side of the side trimmer where it is passed from conveyor 11 onto conveyor 12. In the illustrated production line of FIG. 1, the conveyor 12 pivots about a pivot axis 21 at or near an exit or forward end of the conveyor 12. An actuator such as a pneumatic linear actuator (not shown) operates to lift the entry end of the conveyor to tilt the conveyor 12 about the pivot axis 21 so that in a raised position the conveyor is inclined at the same or similar angle to an angle that the slicing unit 20 is positioned. The conveyor 12 in the raised or tilted position transports the trimmed log into the slicing unit. In an alternative embodiment, the production line may comprise a conveyor or loading table that is set at an incline so that the log is loaded or lifted onto the inclined conveyor for transportation into the slicing unit.

The log is transported from the conveyor 12 onto a third conveyor or table 13. Feed mechanisms such as belts 22 (three shown in FIG. 1) drive the log and hold the log firmly in the slicing unit 20. The feed mechanism 22 is capable of accurately positioning the log within the slicing unit relative to a cutting or slicing blade (not shown). For example, the belts 22 and/or belt of conveyor 13 have teeth or lateral ridges that bite into or press against the surface of the log to grip the log securely for accurate control of the position of the log.

With the log held securely in the slicing unit, a blade of the slicing unit is driven across the log to slice or cut a portion off a forward end of the log. The thickness of the slice cut from the log is determined by the position of the log with respect to the slicing blade. Accurate positioning of the log with respect to the lateral trajectory of the blade allows the thickness of slices to be accurately set. The position of the log is controlled by a controller based on a desired slice dimension, for example slice thickness. The controller and feed mechanisms provide a control arrangement for setting the thickness of slices to be cut from the log. Other slice dimensions may be considered in the control of the log position. For example, a slicing unit that comprises image capture and processing technology can provide the controller with data that the controller can use to determine cross sectional area, density and/or volume information for the log. Based on this information a slice thickness may be calculated by the controller to achieve a predetermined target slice weight or volume or thickness.

In prior art slicing and weighing production lines, slices of food cut by a slicing unit are placed onto a conveyor at the exit side of the slicing unit. Typically a stack of slices is prepared before the conveyor transports that stack to a weigh unit or weigh station. This is achieved by the conveyor remaining stationary during the slicing operation so that a stack or group of slices is stacked from the slicing unit onto the conveyor. Once a predetermined number of slices have been cut, the conveyor then transports the group of slices to a weigh station. The group is weighed at the weigh station and is either directed to a packing area if the weight of that group is above a minimum requirement, or directed to a make-up station if the group is underweight. At the make-up station the underweight group of slices is made up to the required minimum weight by an operator who adds an additional slice to the pack before it is directed to the packing area. This make-up operation is undesirable as it involves labour and can result in a group weight that significantly exceeds the minimum weight requirement. Where a packet of slices is sold based on the minimum weight amount, any excess weight is essentially given away as free product resulting in lost revenue.

In a production system according to one embodiment of the present invention, each slice cut from the log is placed directly onto a weigh unit for weighing the slice at the slicing unit at the location the slice is cut from the log. This arrangement provides a significant improvement over prior art slicing and weighing lines as slice thickness can be adjusted on a slice-by-slice basis to achieve a final pack weight that meets a minimum pack weight requirement without excessive overweight.

For example, a single group of slices has a predetermined number of slices and a predetermined minimum weight requirement. As each slice is cut from the log, each slice drops onto the weigh unit. The weigh unit measures the weight of the group of slices as each slice drops onto the weigh unit. Before the pre-determined number of slices has been cut to make up the complete stack of slices, an output signal from the weigh unit is provided to the controller controlling the position of the log in the slicing unit relative to the slicing unit blade. Based on the signal from the weigh unit the controller can calculate the weight of the incomplete group of slices and adjust the slice thickness of one or more remaining slices required to complete the group of slices and achieve the minimum pack weight requirement. Thus the present invention provides a system that reduces the number of or eliminates underweight packs and also reduces the amount of overweight in a given packet.

In one embodiment, the slicing unit slices a fraction of a total number of slices required in a group. Based on the weight of these slices, the controller sets the slicing thickness for at least one remaining slice to be cut and added to the group to achieve the required minimum pack weight for a predetermined number of slices.

In another embodiment, there is a minimum group weight requirement. The slice thickness is initially set to a predetermined thickness. After slices have been cut and placed on the weigh unit and a fraction of the minimum pack weigh has been achieved, the weight of the slices already measured is used by the controller to determine the thickness (within a given thickness range) and number of slices to be added to the group to achieve the minimum pack weight.

In a preferred embodiment the weigh unit weighs a group of slices as each slice is added to the weigh unit and this weight parameter is provided to the slicing unit controller to set the thickness of the next slice to be added to the group. Therefore, after the first slice has been placed on the weigh unit, the thickness of every subsequent slice is dependent on the weight of the previous slices making up the group of slices.

For example, a requirement for a group of slices may be ten slices weighing a combined total of 200 grams. A first slice is cut at a predetermined thickness or at a thickness set by the cutting of the last slice of a previous group of slices prepared by the slicing and weighing line. Alternatively the thickness of the first slice is calculated. For example, based on information provided by image capture technology, the controller determines a thickness for the first slice based on a target weight (in this example 20 grams). From an image of the log the controller calculates a cross sectional area of the log at the end of the log to be sliced. From the cross sectional area the controller calculates the slice thickness based on the target slice weight and a density figure for slice. The density figure could be an assumed figure for the type of food product being sliced. Alternatively information from the image capture technology may be used to estimate a density figure for the food. For example, the image capture technology may distinguish between colours to determine a fat/lean ratio for meat, for example bacon, or a proportion of cavities or holes in the slice, for example cheese. For a meat product, based on a known average density for fat, a known average density for lean meat, and the fat/lean ratio, a density figure can be estimated for the slice about to be cut.

Once the first slice is cut from the log it drops onto the weigh unit and the load sensor of the weigh unit provides an output dependent on the weight of the slice to the controller from which the controller can determine the measured weight of the slice.

The thickness of the next slice is dependent on the measured weight of the first slice. For example, an error between the target weight and the measured weight of the first slice is calculated and the thickness of the next slice is set so that the weight of the next slice compensates for that error. For example, if the first slice was 22 g, the target slice weight is 20 grams and the error is calculated at 2 g. The next slice should weigh 18 grams to compensate for the overweigh of the first slice. The next slice thickness is adjusted from the first slice thickness, for example by setting the thickness of the next slice as a percentage (in this example by around 82%) of the first slice thickness. This process can be repeated, the measured weight of the preceding slice being used in the calculation for setting the thickness of the next slice.

Alternatively, the measured weight of the first slice could be used to recalculate a density figure for the food being sliced. The corrected density figure can then be used by the controller to calculate the thickness of the next slice. That is, the thickness of the next slice is calculated based on a corrected density value and measured cross sectional area, rather than a thickness that is a percentage greater than or less than the thickness of the previous slice.

In a preferred embodiment the combined weigh of a group of slices is used to determine the thickness of the next slice to be added to the group. For example, once two slices have been placed onto the weigh unit, the combined weight of the two slices is used by the controller to calculate the thickness of the third slice. For example, if the first slice weighed 22 grams and the second slice weighed 19 grams, the combined weight of the two slices is 41 grams. The target weight for the two slices was 40 grams. The error of 1 gram is used together with the target slice weight to determine the target weight of the third slice, in this example being 19 grams. Alternatively, the target combined weight for the stack of three slices is used to determine the target weight of the third slice. The target combined weight for the stack of three slices is 60 grams, therefore the target weight for the third slice is 19 grams (60 grams minus 41 grams).

The third slice thickness is adjusted from the second slice thickness, for example by setting the thickness of the third slice as a percentage of the second slice thickness. In this example, the previous slice weighed 19 grams, the same as the target weight for the third slice. So the controller does not adjust the thickness and the third slice is cut to the same thickness as the second slice.

Alternatively the thickness of the third slice is calculated based on the target weight for the next slice, a density and a measured cross sectional area. This calculation may take into account the previous calculated slice thickness.

This process can be repeated, the measured weight of the group of slices being used by the controller in the calculation for setting the thickness of the next slice to be added to the same group of slices. In the example, if the measured weight of the third slice was 19 grams, the combined weight of the three slices is 60 grams which is equal to the target weight for the three slices. For the forth slice, the target weight of the forth slice is the nominal slice target weight of 20 grams. Alternatively, for the forth slice, the target weight of the stack of four slices is 80 grams, so the target weight for the fourth slice is calculated to be 20 grams.

The process of determining the slice thickness of the next slice to be added to a group of slices based on the combined weight of the slices that have already been cut and weighed for the group of slices is repeated until the predetermined number of slices has been cut or a predetermined pack weight has been achieved. In one embodiment, the last slice is cut slightly thicker than the calculated target slice thickness to ensure a minimum pack weight is achieved. Alternatively, a target group weight to be achieved by the slicing and weighing system is set at a margin above a required minimum pack weight to prevent or reduce underweight packs being produced.

The present invention comprising a food slicing and weighing system that determines from a measured combined weight of a number of slices in a group of slices a target thickness for a next slice to be added to the same group of slices reduces or eliminates the number of underweight stacks of slices produced by the system, improving throughput and reducing the amount of product given away as an overweight amount in a pack of slices sold based on a minimum pack weight.

In order to weigh slices immediately at the exit of the slicing unit the weighing unit is positioned at an exit side of the slicing unit 20 as shown in FIG. 1. The weighing unit may be a standalone unit or part of a slicer and weighing unit assembly.

A weighing unit according to one aspect of the present invention is described with reference to FIGS. 2 to 6. The weighing unit shown in FIG. 2 may be positioned together with a slicing unit to form a slicing and weighing system as shown in FIG. 1.

With reference to FIGS. 2 to 6, the weighing unit comprises a conveyor 31. Conveyor 31 is supported from a base 32 by a load sensor 33. With the weighing unit positioned at the exit of the slicing unit the sliced food product falls or drops from the forward end of the log onto the weigh unit conveyor 31 surface. As the conveyor is supported by the load sensor, any material placed onto the conveyor is weighed by the load sensor. Therefore the weighing unit provides a means to weigh slices immediately at the slicing unit. Once a group or pack of slices has been completed, the weigh unit conveyor moves forwardly to move the pack of slices to, by example, a downstream conveyor for transportation to a packing area and provide a vacant surface for the next pack of slices to be cut onto the weigh unit.

The conveyor comprises a belt 34 that passes around two spaced apart rollers 35, 36. Rollers 35, 36 are rotationally mounted to a conveyor frame 37. In a preferred embodiment, a rear roller 35 is driven by a drive mechanism to drive the belt 34 forwardly and around the two rollers. The forward roller is an un-driven or idle roller which is caused to rotate by movement of the belt driven by the rear roller.

The conveyor frame is supported by a support frame 50. A drive unit is mounted to the support frame for driving the driven roller 35 of the conveyor. The drive unit comprises a motor 46 mounted to the frame. The motor drives the driven roller via a drive belt and pulley system. The drive belt 41 passes around a wheel 42 coupled with a drive shaft of the motor and a second wheel 43 coupled with the driven roller.

The conveyor frame 37 is supported by the support frame 50 without being fastened to the support frame so that the conveyor 31 may be lifted off the support frame without the requirement for the use of tools. The wheel 43 is removably coupled to the driven roller to allow the conveyor to be removed from the support frame. For example, as illustrated the wheel 43 is coupled to a female coupling 44 and the roller is coupled to a male coupling 45. The male coupling is removably received in the female coupling to couple the driven roller to the motor via the belt.

The conveyor is removable from the support frame without tools to provide for easy cleaning of the conveyor belt and the weigh unit surfaces. Further, In a preferred embodiment the frame 37 comprises a forward end 38 that can be moved between two positions, a first position where the forward end of the frame is in a down or operation position and with the belt securely held by the two rollers 35, 36, and a second position where the forward end of the frame is in a raised position for easy removal of the belt 34 from the frame. This arrangement allows the belt to be removed from the conveyor frame without the requirement for the use of tools since one end of the conveyor frame may be pivoted up to loosen the belt 34 from the rollers 35, 36. This allows for easy cleaning of the conveyor including inside surfaces of the belt and the conveyor frame surfaces.

The weighing unit base preferably provides a cabinet with an internal space for housing a load cell or sensor 33. The support frame is supported by the load cell via a post 52 that extends from the load cell through an upper surface of the cabinet. A seal or shroud 39 is provided about the post to prevent or inhibit debris and/or liquids from entering the cabinet. Preferably the seal comprises an internal shroud attached to the base and an external shroud attached to the post to provide a labyrinth. Four legs 47 are attached to the support frame. In normal operation a clearance exists between the bottom of the legs and the base. The clearance is set so that the legs contact the base when an excessive weight is applied to the conveyor to prevent the load cell being overloaded. The support frame 50, drive unit and conveyor are supported by the load cell so that once an item is placed onto the conveyor the weight of the item can be sensed by the load cell.

Preferably the motor is a servo motor. The servo motor can be controlled to accurately control the movement and position of the belt 34. Preferably the servo motor is controlled by a controller that communicates with the slicing unit controller. In a preferred embodiment, a single controller controls both the slicing unit and the weigh unit, for example a controller assembled with the slicing unit. As the slicing unit cuts slices from the log, each slice drops directly on the conveyor 34. For presentation of the slices in a single pack of meat, the controller may control the belt 34 to move forwardly by a small distance between slices so that the slices are layered with a slight offset between each slice. Once a group or pack of slices is completed (either once a predetermined number of slices has been meet or a predetermined weight has been meet, or once both a predetermined number of slices and a predetermined weight has been meet), the controller moves the group of slices forwardly to transfer the group of slices from the weigh unit to a downstream table or conveyor and to provide a clear space on the conveyor for the next stack of slices to be sliced. As the conveyor moves forward, the pack of slices is transferred from the weigh unit conveyor to downstream equipment, for example a conveyor to transport the packs of slices to a packing area.

Figure 7:
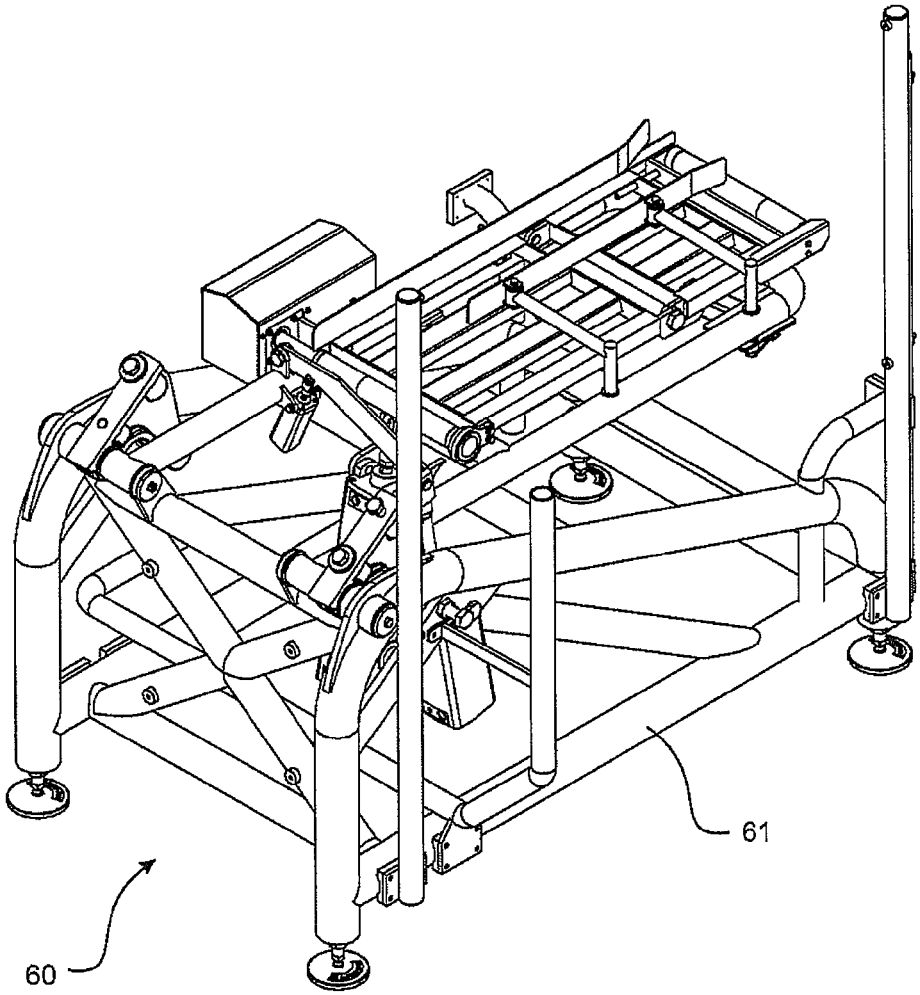
FIG. 7 shows a perspective view of a frame for the slicing unit of the slicing and weighing system of FIG. 1.

As shown in FIG. 1, the various units of equipment that make up the slicing and weighing production line have support frames for supporting the equipment from a floor surface. Preferably the support frames are constructed from round cross section members, for example tubular members. Also, preferably the frames are open and do not include panels that enclose the frames. Open frames (without enclosing covers or panels) formed from round cross sectional members, for example the slicing unit frame 60 as shown in FIG. 7, have been found by the inventors to be particularly useful as they are easy to clean compared to prior art frames constructed from members with flat surfaces (for example angle sections or box sections) and including covers or panels that enclose the interior of the machine. Food debris and other matter tends to sit and remain on flat surfaces and covers make cleaning difficult. An open frame 60 having round cross section members 61, is easy to clean and the members do not have flat surfaces on which food scraps or other matter can sit or collect. When cleaning the equipment after use, cleaning fluids of water may sit or pool on flat surfaces. An open frame having round cross section members does not have flat surfaces on which cleaning fluids or water can sit or pool. Therefore a slicing and weighing system comprising open frames constructed with round cross sectional members is easier to clean and more hygienic compared to prior art slicing and weighing equipment. Preferably the frame members are joined with welded joints to form the frame.

In this specification and claims, a log of food means any food product to be sliced by the slicing unit into slices. For example a log of food could be a block of cheese or a part of an animal, for example a side of bacon.

The controller may be a controller such as a microprocessor included as part of the slicing unit assembly, the controller receiving all inputs necessary to perform the calculations required for determining the calculated thickness. Alternatively the controller may comprise more than one micro processor or calculation device or system. For example, some calculations required for determine the calculated thickness may be performed by a microprocessor or electrical system provided as part of the weighing unit, and/or a microprocessor or electrical system provided as part of the image capturing equipment, for example the camera. In this specification and claims, 'controller' is intended to encompass any and all components in the slicing and weighing system that perform a calculation function for determining the calculated thickness for cutting a slice from a log.

The foregoing description of the invention includes preferred forms thereof. Modifications may be made thereto without departing from the scope of the invention as defined by the accompanying claims.

The invention claimed is:

1. A food slicing and weighing system for producing groups of slices of food product, each group of slices having a total number of slices or a weight greater than or equal to a minimum predetermined group weight, the food slicing and weighing system comprising:

a slicing unit having a blade for cutting slices off a log of food, each slice having a slice thickness, a weighing unit having a load sensor, the weighing unit positioned at the location the slices are cut off the log, the load sensor adapted to sense the weight of slices as each slice is received on the weigh unit, and the load sensor providing a signal, the signal relating to the weight of slices on the weigh unit, and a controller receiving the signal or data based on the signal, the controller programmed to:

i) after each slice is received on the weigh unit for a group of slices determine based on the signal or the data a calculated thickness for a next slice to be cut from the log and received on the weigh unit, ii) provide an output to the slicing unit to set the slice thickness to the calculated thickness, iii) repeat steps i) and ii) until the group of slices has been completed, wherein the signal or the data provides an indication of the combined weight of slices received on the weigh unit for a group of slices or the controller calculates from the signal or the data an indication of the combined weight of slices received on the weigh unit for a group of slices, and in step i) the controller determines the calculated thickness based on the indication of the combined weight and the calculated thickness determined for the previous slice cut from the log and the weight of the previous slice cut from the log.

2. The food slicing and weighing system as claimed in claim 1 wherein in at least 95 % of the groups of slices produced by the food slicing and weighing system the weight of each group of slices is less than 3 % heavier than the minimum predetermined group weight.

3. The food slicing and weighing system as claimed in claim 1 wherein the slicing unit comprises a camera for taking an image of the log and providing a camera signal, the controller receiving the camera signal or data based on the camera signal and based on the cameral signal the controller determining an indication of the cross sectional area of the log, or the data providing an indication of the cross sectional area of the log, and the controller determining the calculated thickness based on the indication of the cross sectional area, a density and the indication of the combined weight.

4. The food slicing and weighing system as claimed in claim 3 wherein the controller determines the density based on the camera signal.

5. The food slicing and weighing system as claimed in claim 4 wherein the food product is meat having a fat content and a non-fat content, and the controller estimates a fat and non-fat content for a slice to be cut from the log based on the camera signal and determines the density based on the estimated fat and non-fat content and a known fat density and a known non-fat density, or wherein the food product has cavities and based on the camera signal the controller estimates the percentage of cavities in a slice to be cut from the log and the controller determines the density based on the estimated percentage of cavities and a known density for the food product without cavities.

6. The food slicing and weighing system as claimed in claim 1 wherein the weighing unit comprises a conveyor supported by the load sensor, the conveyor positioned at the location the slices are cut off the log for receiving the slices to be weighed by the load sensor.

7. The food slicing and weighing system as claimed in claim 6 wherein each slice drops from the log onto the conveyor after being cut from the log.

8. The food slicing and weighing system as claimed in claim 6 wherein once the cutting of a group of slices has been completed and the group of slices has been received on the weigh unit, the conveyor is controlled to transfer the group of slices from the weigh unit so that the conveyor is vacant for receiving a first slice of a next group of slices.

9. The food slicing and weighing system as claimed in claim 6 wherein the conveyor comprises a belt supported by two spaced apart rollers, and the weighing unit comprises a motor removably coupled to at least one of the rollers for driving the belt and a support frame for supporting the conveyor and the motor, the support frame being supported by the load sensor, and the conveyor resting on the support frame and being removable from the support frame without tools.

10. The food slicing and weighing system as claimed in claim 1 wherein the slicing unit comprises a user interface allowing an operator to enter for use by the controller one or more of a user defined target slice weight, a user defined target slice thickness, the total number of slices and the predetermined minimum stack weight, and the controller determines the calculated thickness for at least a first slice of a group of slices based on one or more of the user defined target slice weight, the user defined target slice thickness, the total number of slices, the predetermined minimum stack weight, a calculated thickness and a weight of a slice from a previous group of slices.

* * * * *